United States Patent [19]
Wiancko et al.
[11] 4,444,455
[45] Apr. 24, 1984

[54] FUSE CLIP FOR A CARTRIDGE FUSEHOLDER

[75] Inventors: Paul R. T. Wiancko, Thornhill; Victor D. Koniuk, Scarborough, both of Canada

[73] Assignee: Federal Pioneer Limited, Toronto, Canada

[21] Appl. No.: 58,019

[22] Filed: Jul. 16, 1979

[30] Foreign Application Priority Data

Mar. 9, 1979 [CA] Canada ..... 323148

[51] Int. Cl.[3] ..... H01R 13/38
[52] U.S. Cl. ..... 339/258 F; 337/198
[58] Field of Search ..... 339/252 F, 253 F, 258 F, 339/259 F, 262 F; 337/194–198

[56] References Cited

U.S. PATENT DOCUMENTS 1,930,428 10/1933 Jackson et al. ..... 339/258 F
2,006,611 7/1935 Westberg ..... 337/196
2,294,085 8/1942 Hanson ..... 337/196

FOREIGN PATENT DOCUMENTS 886617 9/1955 Fed. Rep. of Germany ... 339/259 F

*Primary Examiner*—Joseph H. McGlynn
*Attorney, Agent, or Firm*—Beveridge, DeGrandi & Kline

[57] ABSTRACT

A fuseholder assembly for a fusible loadcenter is described. The assembly comprises a fuse unit and a base member. The fuse unit includes a pair of spaced apart U shaped fuse clips axially aligned about the longitudinal axis of a cartridge fuse. The fuse clips each have two mutually opposed wing contact portions that are substantially parallel to the longitudinal axis. The broad contacting surface area of the wing contact portions are capable of making contact with a load or line contact. The base member has an opening therein for receiving the fuse unit. The base member has a load and line contact each of which includes a base portion and two resilient side strips that are closely adjacent to each other. Each side strip is independently biased towards the opening in the base member and lies on a plane normal to the longitudinal axis. Each broad surface area of the wing portions makes wiping electrical contact with a smooth contact surface of a corresponding independently biased side strip when the fuse unit is inserted in the opening of the base member. Previous fuseholder assemblies have a heat producing joint where the contacts join the legs of the fuse clips. The present fuseholder eliminates this heat producing joints by forming the wing contact portion from the legs of the fuse clips. The present assembly also compensates for discrepencies in the lengths of mutually opposed contacts by providing two independently biased side strips.

7 Claims, 9 Drawing Figures

FIG. 5.
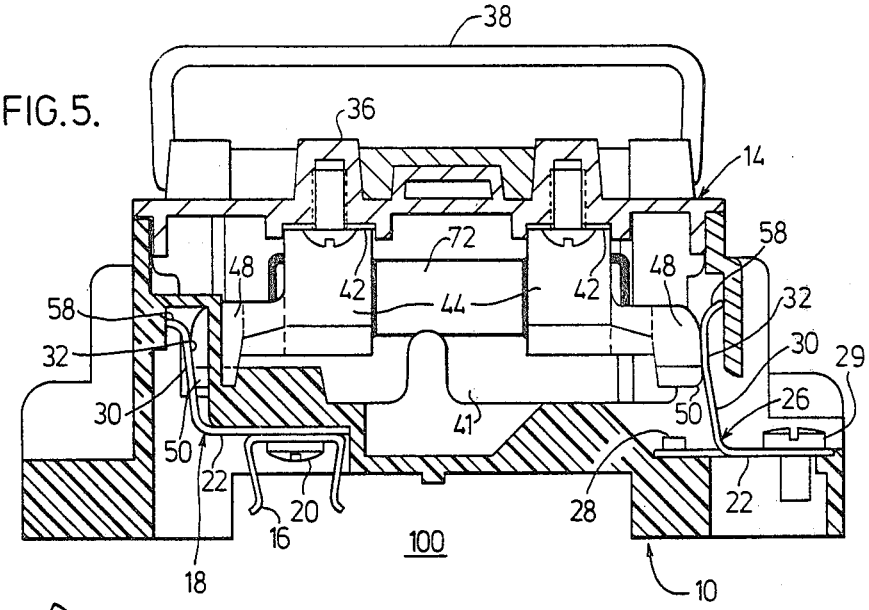
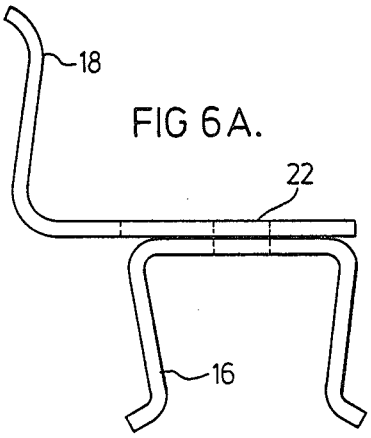
FIG 6A.
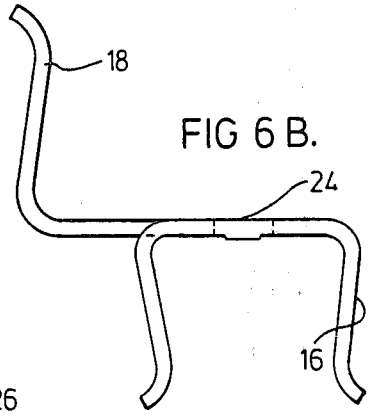
FIG 6 B.
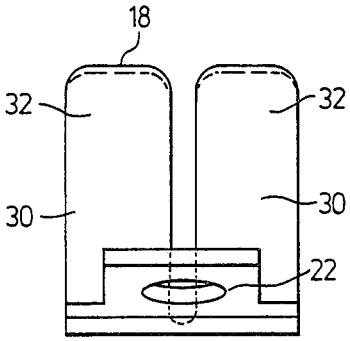
FIG 7A.
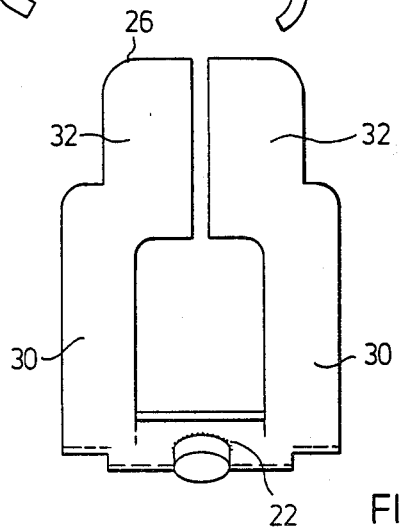
FIG 7B.

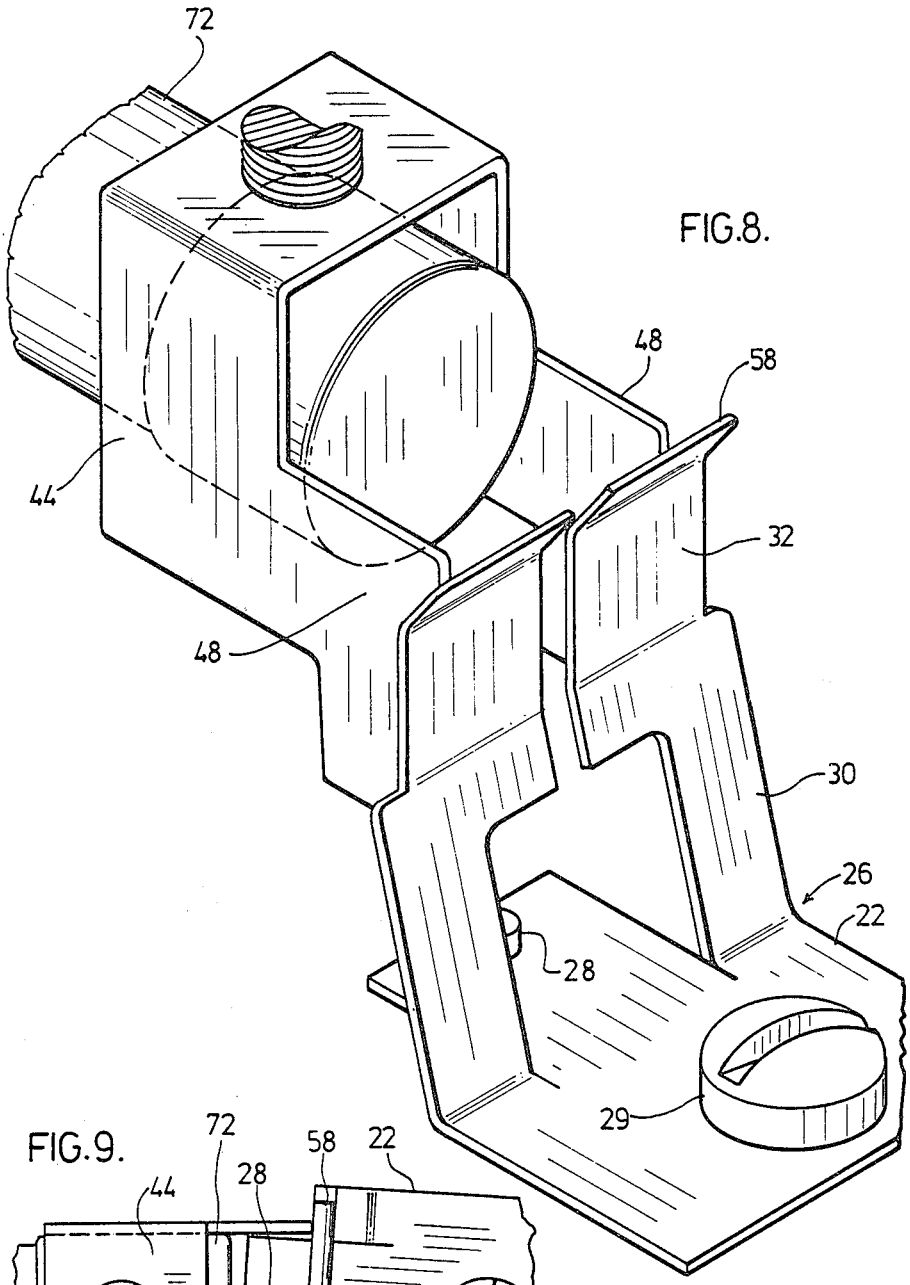
FIG.8.
FIG.9.
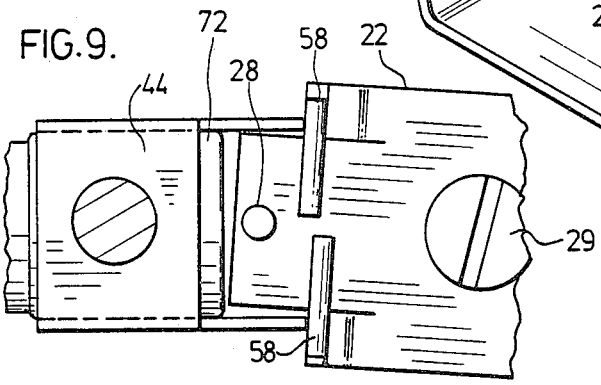

FUSE CLIP FOR A CARTRIDGE FUSEHOLDER

This invention relates to a fuseholder assembly used in fusible loadcenters. In particular it concerns a cartridge fuseholder assembly.

Fusible loadcenters presently in use include both plug fuses and cartridge fuses to control the electrical current distributed through residences, commercial buildings and industrial buildings. For the most part the cartridge fuse is employed for higher current ratings (ie: greater than 35 amps) than the plug fuses. However, the recent increase in large electrical apparatus used in homes such as air conditioners, clothes dryers, water heaters, large home freezers, and baseboard heating has loaded the lower rated plug and cartridge fuses to their rated capacities. Furthermore these loads may be automatically controlled turning on and off several times an hour. This cyclic loading together with the increased use of large electrical apparatus has culminated in a greater generation of heat in the loadcentre, particularly in the fuses and fuseholders. This added heat may cause deterioration of insulating materials, contact surfaces, spring pressures and fuse link conductivity, all of which, in turn, may lead to further increases in heating. Cycling loads cause heating and cooling of these areas which leads to expansion and contraction of parts. This can eventually loosen joints and contact surfaces creating additional heating. Since the zinc link of a typical fuse melts at approximately 400° C., considerable heat can be generated before the fuse opens. In order to continue to provide lower current rating protection, fuses and fuseholder assemblies have been redesigned. Once such redesign is a cartridge fuseholder assembly. This assembly includes a pair of U shaped fuse clips which engage the conductive end portion of the cartridge fuse. A contact material is joined to each leg of the U shaped fuse clip to provide a surface thereon that makes electrical contact with either a load or line contact. The surfaces of the contact materials joined to the legs of the fuse clip are in electrical contacting relationship with a uniform contacting surface for the load or line contact.

One disadvantage with the cartridge fuseholder assembly is that each joint formed by joining the contact material to each leg of the fuse clip may create a heat producing joint. Due to the enclosed environment associated with the cartridge fuseholder, it is important that as few heat producing joints be created as possible. Dissipation of excessive heat through the fuseholder assembly may result in the deterioration of the insulating materials contact surfaces, springs, etc.

Another disadvantage with the cartridge fuseholder is that manufacturing tolerances allow for differences in the length or size of contact materials joined to different legs of the fuse clip. These differences may result in only one of the contact materials being in satisfactory electrical contacting relationship with the uniform contacting surface of either the load or line contacts. Hence, the entire current drawn by the load passes through one leg of the fuse clip and its associated contact material. This may result in early deterioration of this leg of the fuse clip and its contact material due to the cylic loading and increased use in large electrical apparatus.

It is therefore one feature of this invention to provide a fuseholder assembly that eliminates a heat producing joint between each leg of a fuse clip and the leg's contacting surface.

It is a further feature of this invention to provide a fuseholder assembly that compensates for any descrepencies in the size of contact surfaces for a fuse clip.

This invention relates to a fuseholder assembly for a cartridge fuse. The fuseholder assembly includes a pair of spaced apart U shaped fuse clips that are axially aligned about the longitudinal axis of the cartridge fuse. The fuse clips include two mutually opposed blade contact portions that are substantially parallel to the longitudinal axis of the fuse. Each blade contact portion comes into electrically contacting relationship with a smooth contact surface of either a load or line contact. The smooth contact surface is formed from a part of a side strip that extends from a base portion of either the load contact or line contact. For each base protion there are two resilient side strips that lie closely adjacent to one another. The smooth contact surface portion of each resilient side strip is independently biased towards one of the two mutually opposed blade contact protions and lies on a plane normal to the longitudinal axis. The independent biasing of the side strips and their smooth contact surface portions ensures that the load or line contact is in electrical contacting relationship with the fuse clip at two points. Also, the blade contact portions of each fuse clip are significant in that they form a part of the fuse clip eliminating a heat producing joint therebetween.

Additionally the fuse clips may be included in a removable fuse unit and have wing contact portions. An arcuate edge contact surface of each wing contact portion makes wiping electrical contact with a corresponding smooth contact surface portion of a side strip when the fuse unit is inserted into a base member containing the load and terminal contacts.

In accordance with one form of the invention there is provided a fuseholder assembly for use with a cartridge fuse having a longitudinal axis. The assembly is characterized by a pair of spaced apart fuse clips that are axially aligned about the longitudinal axis. Each of the fuse clips has a base and two legs extending outwardly from the base to substantially form a U shape within which each of the fuse clips is capable of holding a conductive end portion of the fuse. A line contact and a load contact each make electrical contact with a different one of the spaced apart fuse clips. The improvement in the fuseholder assembly comprises at least one of the fuse clips having two mutually opposed contact portions which are substantially parallel to the longitudinal axis and at least one of the line contact and the load contact includes a base portion having two resilient side strips each having a smooth contact surface portion independently biased towards one of the two mutually opposed contact portions to provide an electrical contact therewith.

For a better understanding of the nature and objects of the invention reference may be had, by way of example, to the accompanying diagrammatic drawings in which:

FIG. 5 is side view partly in section showing an assembled fuseholder;

FIGS. 6A and 6B show alternate embodiments for the bus clip and terminal contact of the fuseholder assembly;

FIGS. 7A and 7B show respective embodiments for line and load contacts;

FIG. 8 is an enlarged isometric view showing the electrical contacting relationship between the edge portions of the mutually opposed wing portions and the smooth portions of each side strip of a line terminal; and FIG. 9 is a plan view showing the contacting relationship as shown in FIG. 8.

Figures 1, 2, 3, 4:
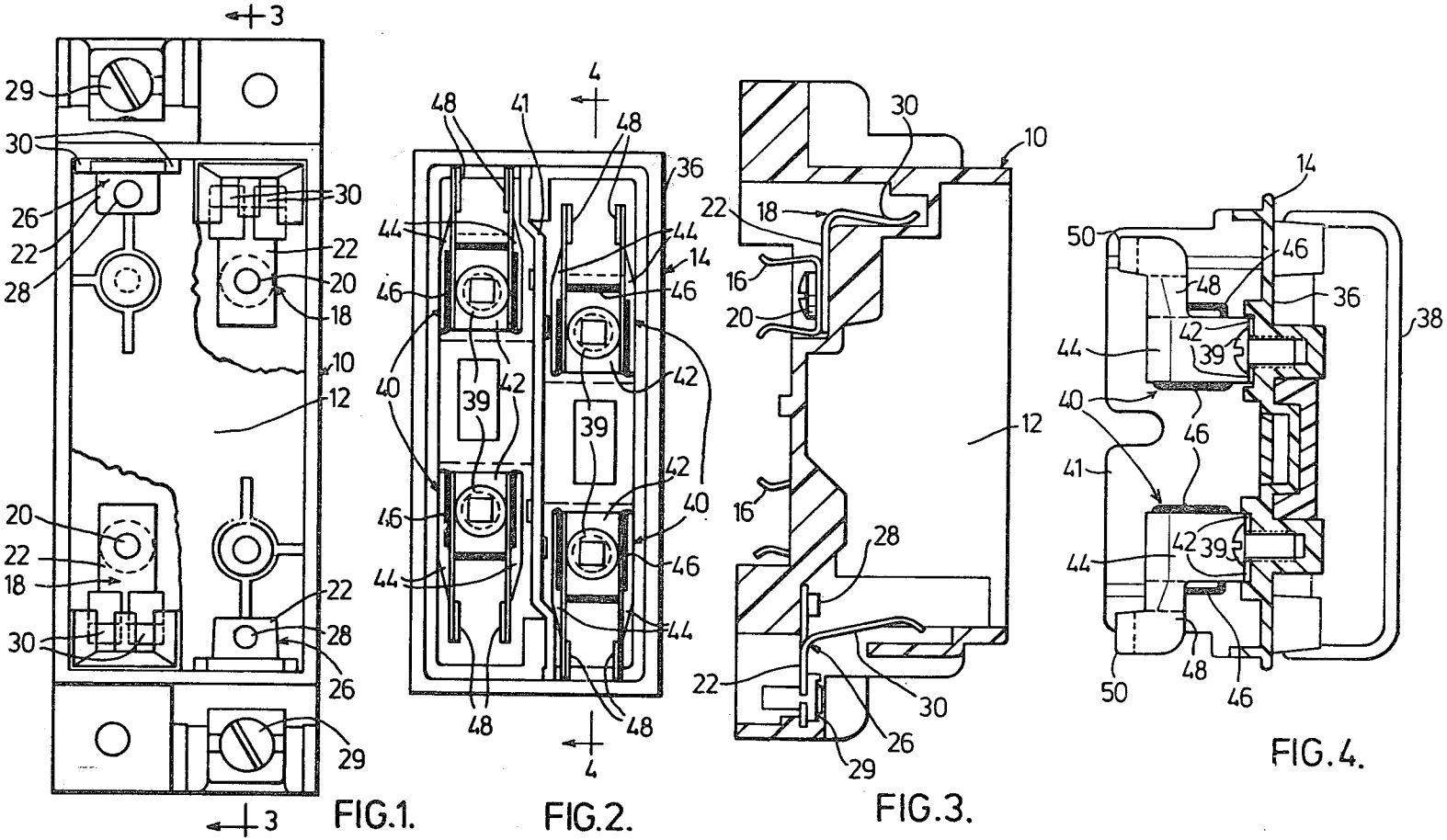
FIG. 1 is a top view showing the base member of the fuseholder assembly.
FIG. 2 is a bottom view showing the removable fuse unit of the fuseholder assembly.
FIG. 3 is a sectional side view of the base member taken along section 3—3 of FIG. 1.
FIG. 4 is a sectional side view of the removable fuse unit taken along sectional lines 4—4 of FIG. 2.

The fuseholder assembly of the preferred embodiment is now described with reference to FIGS. 1 through 4 and FIGS. 8 and 9. The fuseholder assembly of the preferred embodiment is for current ratings of 30 amperes or less. A base member 10 has a central opening 12 therein for receiving fuse unit 14. Base member 10 is secured to bus bars of a fusible loadcenter (not shown) by means of bus clips 16. Each bus clip 16 is secured to a terminal contact 18 in a suitable manner such as screws 20. It should be understood from FIG. 6A that bus clip 16 may be silver soldered to base 22 of terminal contact 18 or from FIG. 6B that bus clip 16 may share a common base 24. Also included in base member 10 is a load contact 26 secured by rivet 28 to member 10. It should be understood that wire (not shown) may be secured to screw 29 so as to provide a path to distribute electrical current from the cartridge fuseholder assembly to various electrical loads.

Referring now to FIGS. 1, 3, 7A and 7B line contact 18 and load contact 26 are shown having their respective base portions similarily designated 22, secured to member 10. Line contact 18 and load contact 26 are both made from a suitable electrically conductive material such as, for example, aluminum, brass, bronze, silver, copper and other suitable alloys. In the embodiment shown the contacts are made from bronze. Contacts 18 and 26 each include two resilient side strips 30 which lie adjacent to one another (FIGS. 7A and 7B). Each side strip 30 has a smooth contact portion 32 lying on a plane normal to the longitudinal axis of the cartridge fuse (not shown). Because the two side strips 30 and their respective smooth contact surfaces 32 extend independently from the contact's base 22, the side strips 30 may be independently biased. FIGS. 1 and 3 clearly show the side strips 30 being independently biased by the spring action of the material towards central opening 12 of member 10.

Referring once more to FIGS. 1 through 4 and FIGS. 8 and 9 there is shown a removable fuse unit 14 having a cover 36 which covers central opening 12 when fuse unit 14 is inserted into base member 10. Cover 36 is provided with handle 38 so that fuse unit 14 may be removed from base member 10. Secured to the inside of cover 36 by screws 39 are two pairs of fuse clips 40. Located between adjacent pairs of fuse clips 40 is an insulating partition 41. It should be understood that for each pair of fuse clips 40 there is associated one corresponding line contact 18 and one corresponding load contact 26.

Each pair of fuse clips 40 are spaced apart and axially aligned about a central axis that is defined by the longitudinal axis of the cartridge fuse (not shown) which is to be inserted into the pair of fuse clips. Fuse clips 40 include a base 42 and two legs 44 that extend outwardly from base 42 to substantially form a U shape for gripping a conductive end of a cartridge fuse. Fuse clips 40 may also have a U shaped spring wire member 46 which in combination with legs 44 hold conductive end portions of a cartridge fuse (not shown). Fuse clips 40 each include two mutually opposed wing contact portions 48 which are substantially parallel to the central axis. Wing contact portions 48 each provide an arcuate broad contact surface area 50 which is capable of making electrical contact with a corresponding side strip of side strips 30.

Referring now to FIG. 5 the fuseholder assembly is shown generally at 100 with removable fuse unit 14 inserted into base member 10. Cover 36 covers central opening 12. As fuse unit 14 is inserted each arcuate contact surface area 50 engages a corresponding curved tip or guide portion 58 shown at the upper end of each side strip 30. As fuse unit 14 is inserted further into member 10, each surface area 50 slides down the corresponding smooth contact portion 32 thus making a wiping electrical contact. This wiping contact is primarily due to surface area 50 being rigid and each corresponding side strip 30 pressing inwardly due to its independent biasing. Smooth contact surfaces 32 of side strip 30 are shown substantially normal to the central axis.

In operation, electrical current passes from a bus bar of a fusible loadcenter (not shown) through bus clip 16 into base portion 22 of line contact 18. From here current passes through two side strips 30 of contact 18 into wings 48 of the left hand fuse clip 40. Current passes from wings 48 through legs 44 and into conductive end portion 70 of cartridge fuse 72. If the current is higher than the rating of fuse 72, fuse 72 open circuits and prevents current from passing any further. If the current is less than the rating of fuse 72, current passes out of conductive end portion 74 and into legs 44 of the right hand fuse clip. From here current passes into wing contact portions 48 and onto side strips 30 of load contact 26. Load contact 26 passes current to a wire (not shown) secured to screw 29. The wire provides a current path for the electrical power to various loads attached to the loadcenter. It should be noted that because wings 48 and legs 44 are formed together from the same material a heat producing joint is eliminated. Furthermore, side strips 30 are independently biased towards one corresponding wing contact portion 48. Each independently biased side strip 30 provides an electrical contact with its corresponding wing contact portion 48. The independent biasing of the side strips 30 compensates for any descrepencies between the lengths of two mutually opposed wing contact portions 48.

What I claim as new and desire to secure by Letters Patent of the United States is:

1. A fuseholder assembly for use with a cartridge fuse having a longitudinal axis, said assembly characterized by a pair of spaced apart fuse clips that are axially aligned about said longitudinal axis, each of said fuse clips having a base and two legs extending outwardly from said base to substantially form a U shape within which each of said fuse clips is capable of holding a conductive end portion of said fuse, a line contact and a load contact each making electrical contact with a different one of said spaced apart fuse clips, the improvement in said fuseholder assembly comprising said fuse clips each having two mutually opposed blade portions which are substantially parallel to said longitudinal axis, each blade portion having a broad contacting surface area, said line contact and said load contact each including a base portion having two resilient side strips lying closely adjacent to one another, each of said side strips having a smooth contact surface portion lying on a plane normal to said longitudinal axis and being independently biased towards said broad contacting surface area of a corresponding one of said two mutually opposed blade portions to provide wiping electrical contact therewith.

2. The fuseholder of claim 1 wherein each of the two mutually opposed blade portions is a wing portion, said broad contacting surface area having an arcuate portion adopted for electrical contact with said smooth contact surface.

3. The fuseholder assembly of claim 2 further including a bus clip having a base portion in electrical contacting relationship with the base portion of said line contact and said bus clip having two arms for clipping onto a bus bar.

4. The fuseholder assembly of claim 3 wherein the base portion of said bus clip and the base portion of said line contact are soldered together with silver solder.

5. The improvement in the fuseholder assembly of claim 3 wherein the base portion of said bus clip and the base portion of said terminal contact are one and the same.

6. A fuse assembly for a cartridge fuse having a longitudinal axis, said assembly comprising:

a base member having central opening therein, said base member including at least one load contact and at least one line contact, each of said at least one load and line contacts being positioned adjacent said central opening and including a base portion having two resilient side strips lying closely adjacent to one another each having a smooth contact portion lying on a plane normal to said longitudinal axis and being independently biased towards the interior of said opening, a removable fuse unit for insertion into said central opening, said fuse unit including a cover having secured thereto at least one pair of spaced apart fuse clips that are axially aligned about said longitudinal axis, each of said fuse clips having a base and two legs extending outwardly from said base to substantially form a U shape within which each of said fuse clips holds a conductive end portion of said fuse, each of said pair of fuse clips having two mutually opposed wing portions which are substantially parallel to said longitudinal axis and having a broad contacting surface area, and said broad contacting surface area making wiping electrical contact with a corresponding smooth contact surface when said removable fuse unit is inserted into said central opening to provide an electrical path from said at least one terminal contact to said at least one load contact through said at least one pair of fuse clips and said fuse.

7. The fuseholder assembly of claim 6 wherein said side strips are provided with guide portions at their upper ends to guide the broad contacting surface area of each of the two mutually opposed wing contact portions onto the smooth contact surfaces of the side strips.

* * * * *